US006457394B1

(12) United States Patent
Granger

(10) Patent No.: US 6,457,394 B1
(45) Date of Patent: Oct. 1, 2002

(54) WIPING MATERIAL AND TOILET PAPER DISPENSING APPARATUS WITH AUTOMATIC OR SEMIAUTOMATIC FUNCTIONING

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/700,895

(22) PCT Filed: Sep. 4, 1999

(86) PCT No.: PCT/FR99/00815

§ 371 (c)(1),
(2), (4) Date: Nov. 20, 2000

§ 102(e) Date: Nov. 20, 2000

(87) PCT Pub. No.: WO99/60907

PCT Pub. Date: Dec. 2, 1999

(30) Foreign Application Priority Data

May 28, 1998 (FR) ..... 98 06928

(51) Int. Cl.[7] ..... B65H 35/08; B26D 1/56; B26D 5/38

(52) U.S. Cl. ..... 83/649; 83/298; 83/334; 83/337

(58) Field of Search ..... 83/649, 337, 589, 83/298, 339, 334, 335, 314, 949

(56) References Cited

U.S. PATENT DOCUMENTS 1,802,554 A * 4/1931 Hahn ..... 83/305
2,237,759 A * 4/1941 Kwitek ..... 242/523
4,635,837 A * 1/1987 Granger ..... 225/106
4,846,035 A * 7/1989 Granger ..... 83/337
5,013,291 A * 5/1991 Granger ..... 225/103
5,146,830 A * 9/1992 Granger ..... 83/337
5,209,151 A * 5/1993 Takagi et al. ..... 400/621
5,937,718 A * 8/1999 Granger ..... 225/106
5,979,284 A * 11/1999 Granger ..... 225/106
6,079,305 A * 6/2000 Bloch et al. ..... 83/335
6,112,631 A * 9/2000 VanAlstine ..... 225/15

FOREIGN PATENT DOCUMENTS

FR 2701016 8/1994

* cited by examiner

*Primary Examiner*—Boyer Ashley
*Assistant Examiner*—Thomas J Druan, Jr.
(74) *Attorney, Agent, or Firm*—Wall Marjama & Bilinski LLP

(57) ABSTRACT

An apparatus for dispensing a paper wiping material includes a toothed spur mechanism which includes an arm which pivots counter to an elastic return relative to a pivotally mounted cutter blade holder. The arm includes a curvilinear section having a plurality of teeth which engage a fixed rack. The engagement defines an angular sector bounded by the initial contact area between the teeth of the fixed rack and the arm, the pivot axis of the toothed spur mechanism and the cutting surface of the cutting blade which extends approximately 160 to 170°. The elastic return includes a first end which is fixed to a tab of the blade holder and a second arm which is fixedly attached to the arm permitting an elastic interconnection.

1 Claim, 6 Drawing Sheets

WIPING MATERIAL AND TOILET PAPER DISPENSING APPARATUS WITH AUTOMATIC OR SEMIAUTOMATIC FUNCTIONING

FIELD OF THE INVENTION

The invention relates to the technical field of apparatuses for dispensing paper wipes made of cellulose wadding, crepe paper or suchlike materials intended more particularly for users to wipe their hands, of toilet paper.

BACKGROUND OF THE INVENTION

Very many types of automatically and semiautomatically operating apparatuses for dispensing wiping materials exist and the applicant has developed several apparatuses of this type capable of dispensing strips of folded or unfolded material. These apparatuses, which give satisfactory service, are of the type comprising a moulded plastic housing accommodating in its upper part a feed reel of wiping material, a drum containing a cutter device with a serrated blade, and a presser means for feeding the strip of paper towards the drum and tensioning the paper. The cutter blade is pivoted inside the drum and moved by engagement of a fixed toothed spur connected to the pivot of the cutter blade and engaging with a fixed rack means positioned internally on one of the sides of the housing. An arrangement of this type has been described in particular in French Patent No. 2,701,016 by the Applicant. Additionally, the end of this drum is provided with a cocking mechanism with a crank and a return spring as described and illustrated in patent FR 2340887.

Nevertheless, the tractive force necessary to unwind the strip of material so that it can be cut is large, approximately one kilogram. This force may be made greater according to the quality of the materials handled, their thickness, and their presentation with or without folds, depending on the arrangement of the apparatus.

The Applicant has therefore carried out further research in order to improve still further the reliability of the apparatus and reduce the forces required of the user when he or she pulls on the strip of material.

The reduction of the tractive forces thus lead the Applicant to examine more closely the mechanism allowing the drum to rotate upon itself and enabling the cutter blade to be extended. Thus, FIG. 1 of the drawings shows a dispensing apparatus according to the prior art described in French Patent No. 2,701,016. A rack means is mounted on the drum shaft and comprises a plurality of teeth forming a rack, the first teeth being of constant profile and those which follow being of a progressive profile in order to bring about the movements of the cutter blade. In addition, the end of the blade capable of being moved towards the rack means includes a fixed part forming a spur on which a plurality of teeth form a pinion located progressively further and further away from the shaft of the blade, the leading tooth being taller in order to bring about meshing. This part forming the spur is fixed to the shaft of the blade in an eccentric position, so as to bring about the angular pivoting of the blade and of the part forming the spur. In this particular embodiment there is found to be a continuous relative positioning of approximately 90° between the initial contact area of the mesh between the fixed rack and the spur. the pivot axis of the blade holder and the end or region of cutting of the blade about a bounded angular sector identified in FIG. 1 by the letters XOX, and having an angle ($\alpha$). This angle ($\alpha$) is constant throughout the rotation of the drum when one piece of the strip of material is being cut.

SUMMARY OF THE INVENTION

Applicant has therefore conceived of the possibility of modifying this angle in order to see whether there could be effects on the tractive force of the strip of material pulled by the user.

Surprisingly, it was found that a substantial modification of this angle by an increase in its amplitude had the result of reducing the tractive force required to pull the strip of paper, thus not inconsiderably improving the convenience of use of the apparatus.

Consequently, in a first feature of the invention, the toothed spur mechanism (8) comprises an arm (8*a*) which pivots counter to an elastic return means (12) relative to the blade holder, the arm defined by a curvilinear form having a plurality of teeth (8*d*) able to engage with the rack means (9) and defining an angle ($\alpha$1) defined by the initial contact area of meshing between the teeth of the arm and the rack means, the pivot axis of the toothed spur and the cutting region of the blade through an angular sector YOY which is approximately 160 to 170° .

These and still other features will become clear in the course of the description.

BRIEF DESCRIPTION OF THE DRAWINGS

In order to provide a clear idea of the subject of the invention, illustrated in a non-restrictive manner in the figures of the drawings in which.

DETAILED DESCRIPTION OF THE INVENTION

Figure 1:
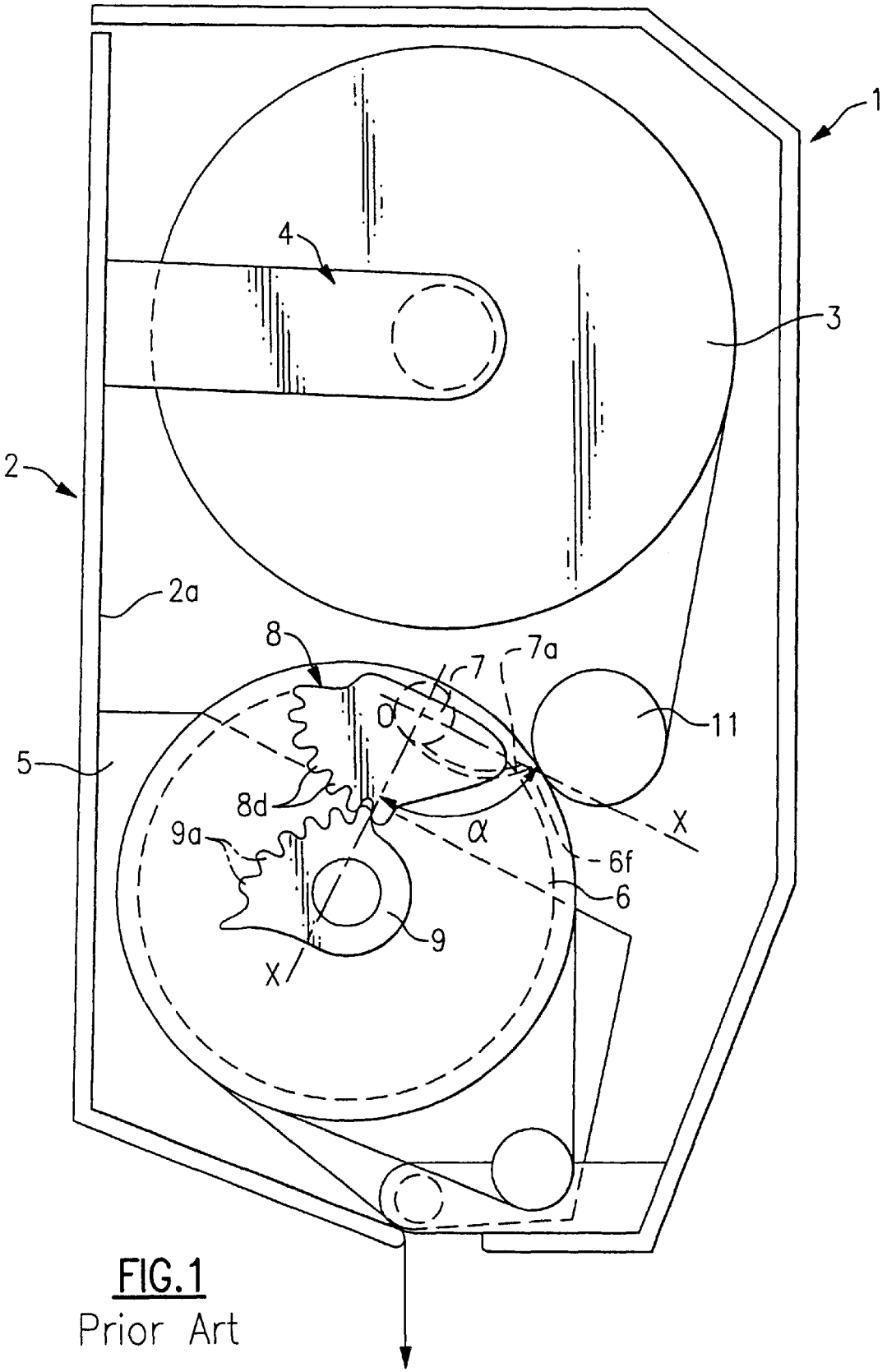
FIG. 1 Prior Art
FIG. 1 is a side view of the dispensing apparatus according to the prior art defined in particular in Patent FR 2,701,016.
Figure 2:
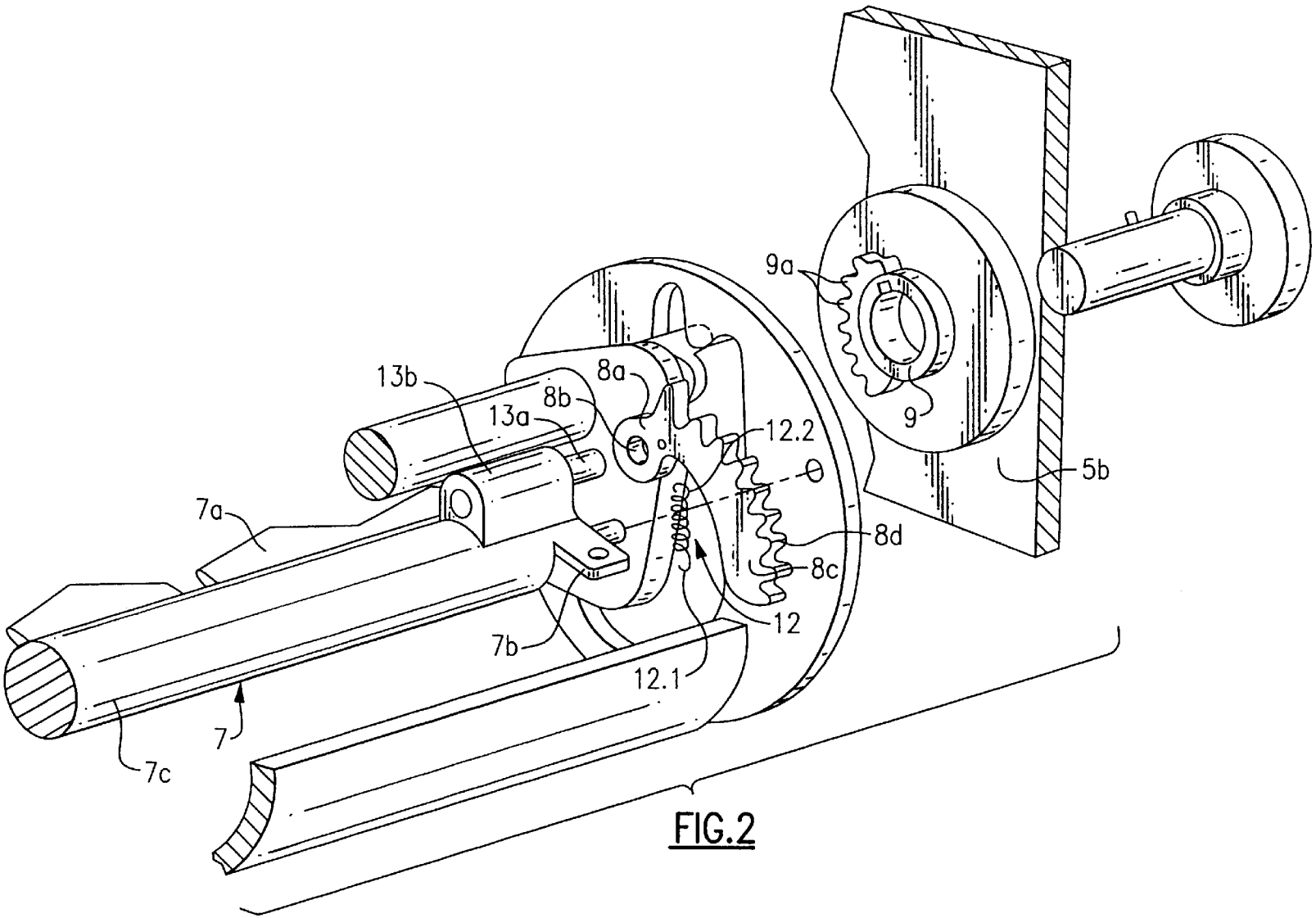
FIG. 2 is a perspective view prior to assembly of the device of the invention permitting a reduced tractive force.

In order to render the subject of the invention more concrete, it is now described in a non-restrictive manner illustrated in the figures of the drawings.

In a known matter, the dispensing apparatus for hand wipes and toilet paper bearing the general reference (1) comprises a moulded plastic housing (2) capable of accommodating in its upper part a feed reel (3) of wiping material of toilet paper held between upper reel-supporting side plates (4) fitted to the back of the housing or otherwise. Lower side plates (5) are fitted to the rear face (2*a*) of the housing and are provided with slots to allow fixing and fitting of the drum (6), which contains a cutter device (7) with a serrated blade (7*a*) and a blade holder (7*c*). This cutter device is unusual as described previously with an arrangement on one of the sides of the drum which comprises a toothed spur mechanism (8) connected to the cutter blade which engages with a fixed rack (9) on the inner side (5*b*) of the lower side plate (5) of the housing. The drum (6) contains a longitudinal opening (6*f*) through which the cutter blade (7*a*) can be extended. The drum is constructed in a known manner on its other side with an arrangement not illustrated in the drawings and corresponding to the teaching of French Patent 2340887. containing a cocking and return mechanism with a crank and spring. The apparatus comprises, in addition, a presser means (11) in the form of a cylinder which is the same length as the drum and can press the drum, being positioned between the aforementioned side plates According to the invention. the fixed rack (9) possesses a plurality of teeth (9*a*) formed with the profile and configuration defined in Patent FR 2,701,016. By contrast. the spur mechanism (8) is laid out in such a way as to comprise an arm (8*a*) which is pivoted counter to an elastic return means (12) of which one end (12.1) is fixed to a tab (7*b*) on the blade holder (7*c*) of the cutter device and the other end (12.2) is fixed to the [said] arm. The arm (8*a*) comprises at its base (8*b*) a ring shape able to fit rotatably on a pin (13*a*) projecting from a fixed boss (13*b*) fitted to or cast or moulded with the blade holder (7*c*).

Figure 3:
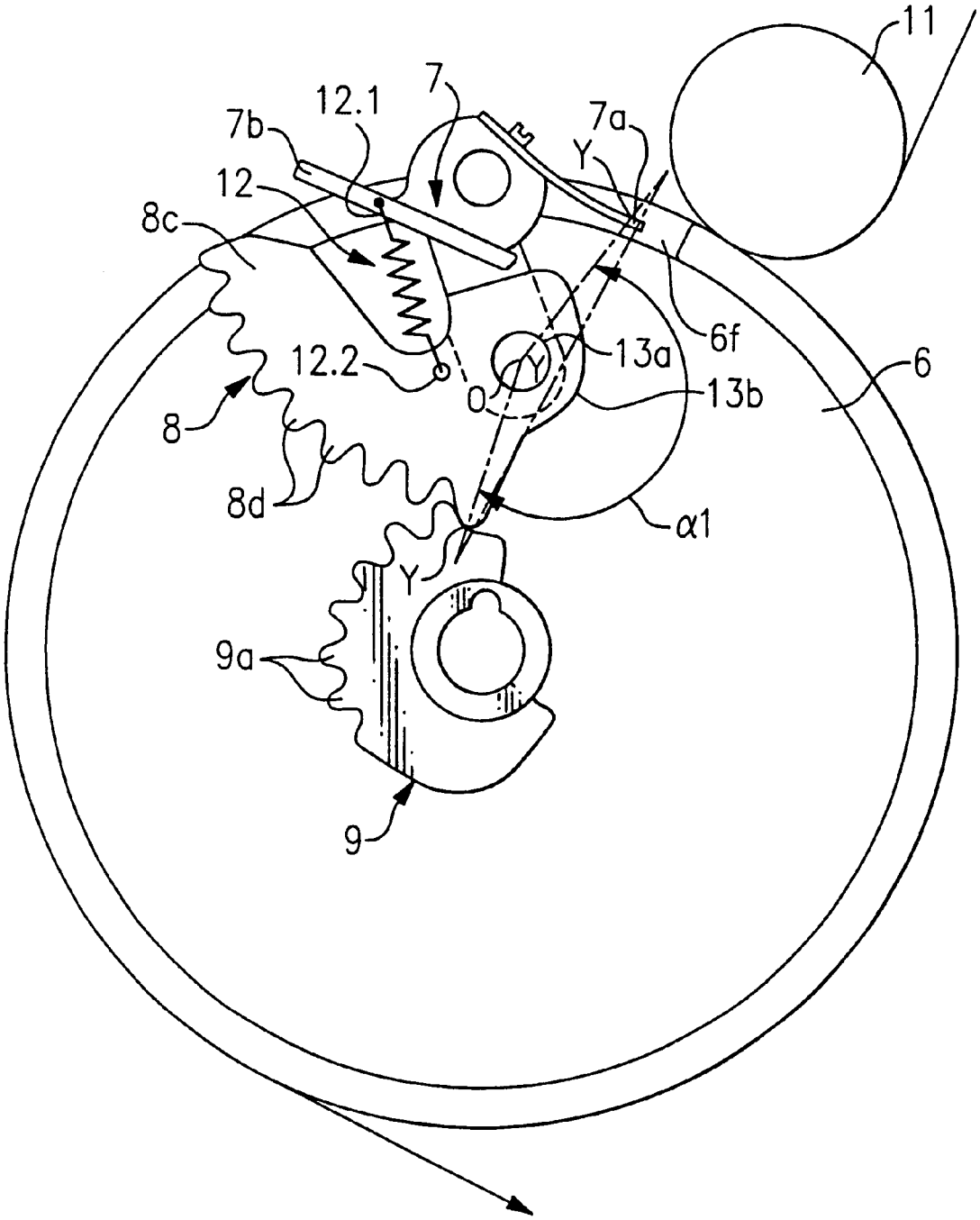
FIG. 3 is a diagrammatic type of view illustrating the position of the cutter device and of the blade at the beginning of the rotation of the drum prior to the cut.
Figure 4:
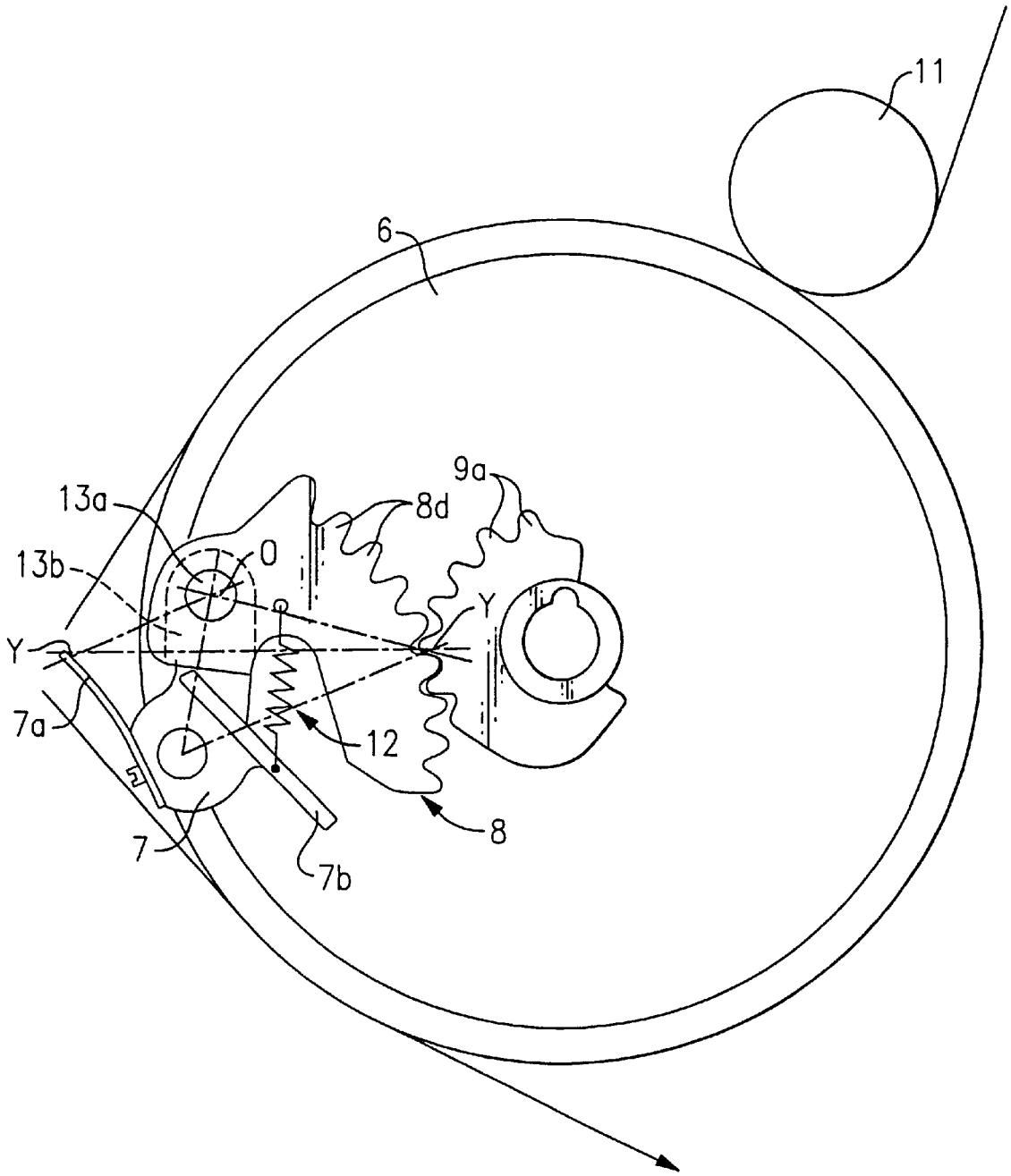
FIG. 4 is a view similar to FIG. 3 in a position in which the strip of material is being cut after a partial rotation of the drum.
Figure 5:
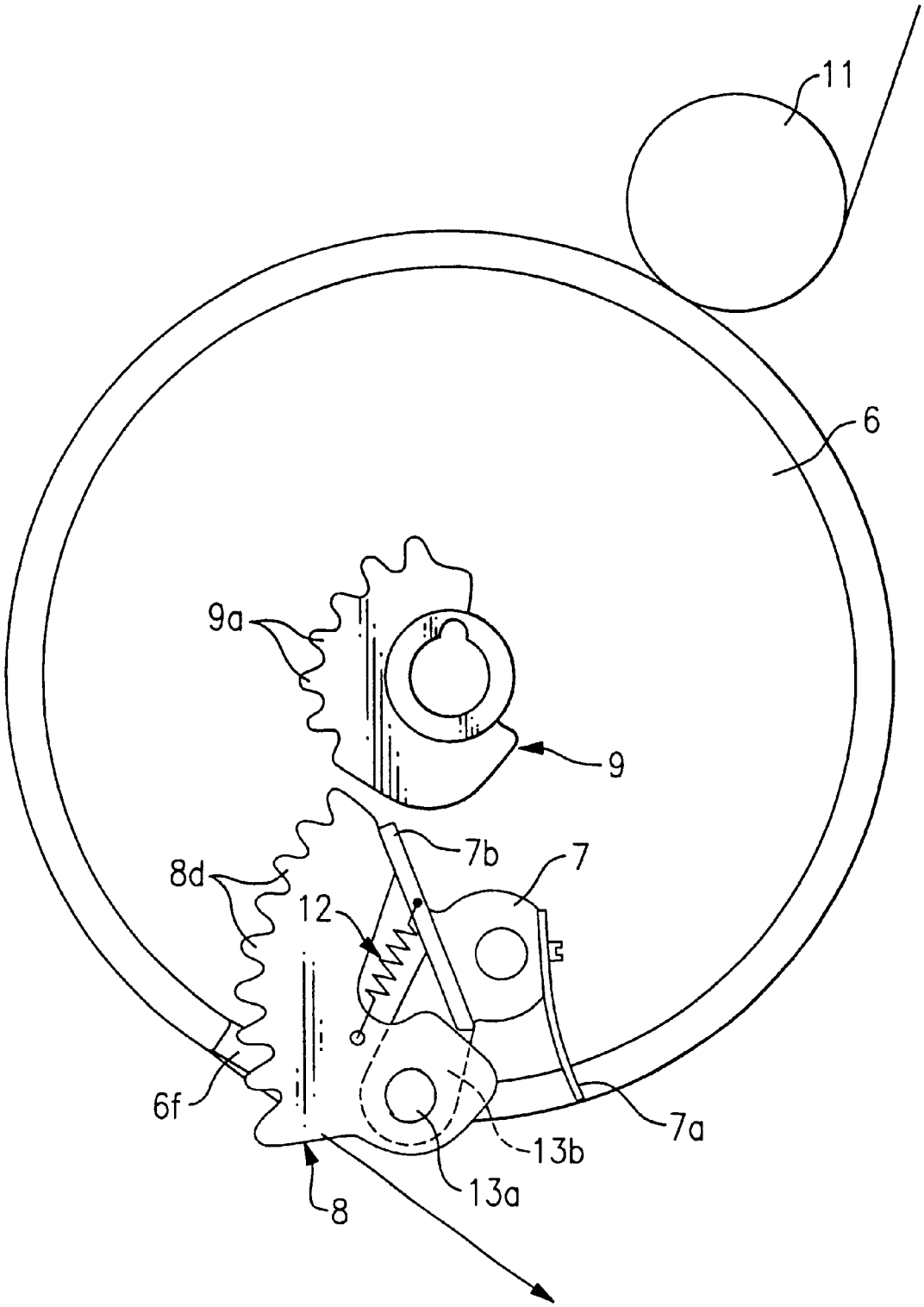
FIG. 5 is a view following FIGS. 3 and 4 at the conclusion of the rotation of the drum, as the latter is returned after the cut has been made.
Figure 6:
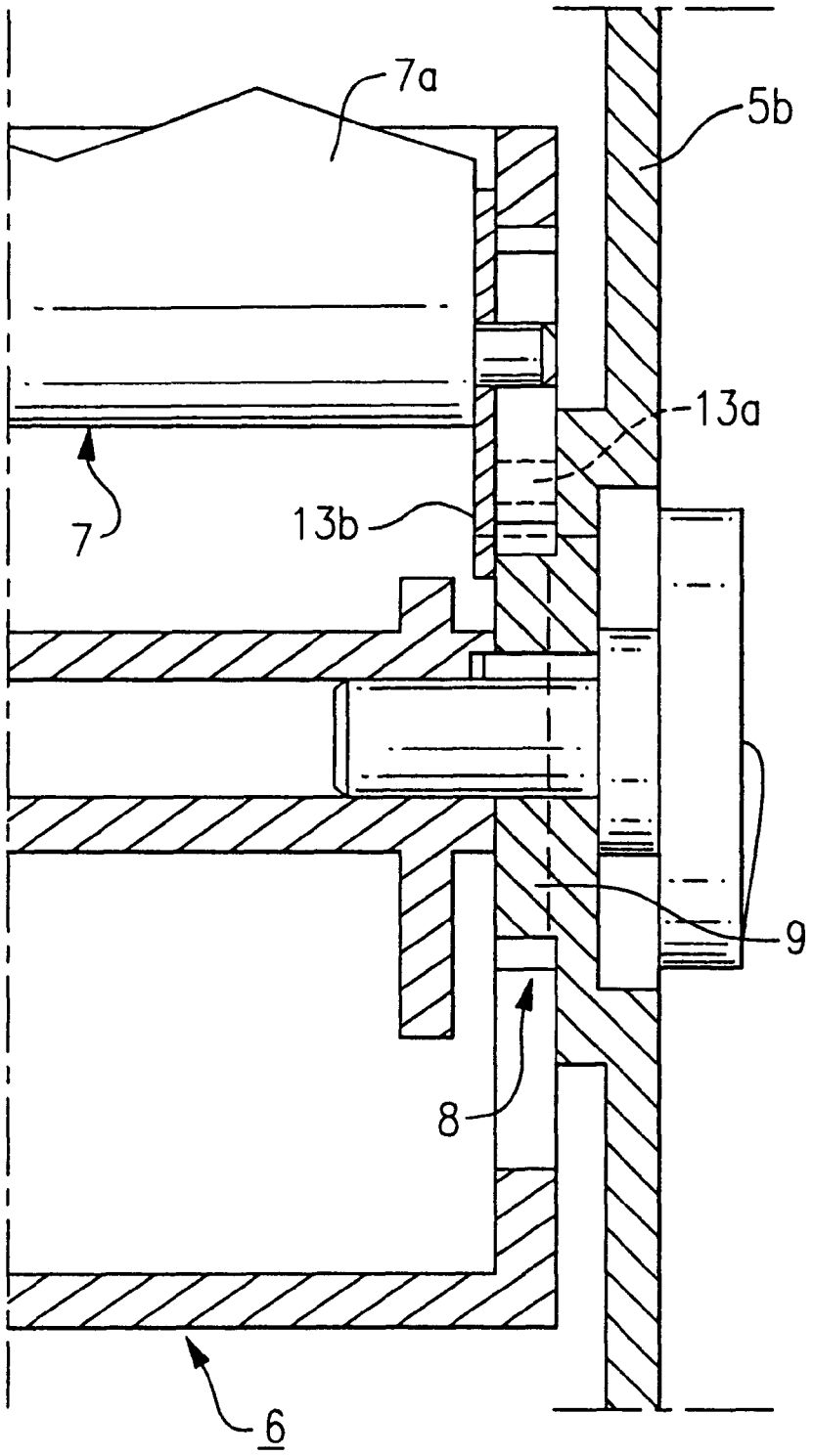
FIG. 6 is a front view in partial section from FIG. 2 of the assembled device.

The arm (8*a*) extends at its front end in the form of a curvilinear sector (8*c*) whose upper face comprises a plurality of teeth of the type corresponding to the teeth (8*d*) formed on the toothed spur described in Patent 2,701,016. The arm is therefore capable of pivoting on a floating elastic mounting. The arm is able, as the drum is turned for the cut, to move away from the blade holder (7*c*) of the cutter device (7), so modifying the angle ($\alpha$1) which is defined by the initial contact area of meshing between the teeth of the fixed rack (9) and the arm (8), the pivot axis of the toothed spur, and the cutting region of the blade (7*a*). This creates an angular sector represented as YOY which is approximately 160 to 170° as shown in FIGS. 3 and 4. This amplitude is approximately constant as the drum rotates and, by the elastic mounting of the arm (8*a*) acting as a pinion, it substantially reduces the tractive force required on the strip of material which has thus been measured and found to be approximately 300 to 400 grams. This reduction is due to the fact that the resistive force applied by the drum during its rotation is smaller owing to the flexibility of the linkage between the elastic return means (12) and the arm (8) and cutting blade holder (7*c*) and of the aforementioned meshing of the rack (9) and the spur (8). The result of this is greater convenience of use of the apparatus.

What is claimed is:

1. Apparatus for dispensing a paper wiping material, said apparatus comprising a housing, a feed reel of wiping material accommodated in an upper part of the housing, a supporting drum mounted between fixed internal side plates of said housing, said drum having a slot for receiving a serrated blade end of a cutter device, said cutter device including a pivotally mounted blade holder mounted within said drum, and a presser means for pressing on the exterior of the drum in order to feed and tension a strip of paper fed from said feed roll passing therebetween, said cutter blade being pivotally movable inside of said drum and moved by engagement of a toothed spur mechanism connected to said blade holder, said spur mechanism engaging with a fixedly mounted rack having a plurality of teeth, said rack being fixedly positioned on one of the side plates of the housing, wherein the improvement is characterized by:

said toothed spur mechanism including an arm which pivots counter to an elastic return means relative to the blade holder, said arm including a curvilinear sector having a plurality of teeth which engage with the teeth of the fixed rack, said engagement defining an angular sector bounded by the initial contact area between the teeth of the fixed rack and the arm, the pivot axis of the toothed spur mechanism and the serrated cutting surface of the cutting blade which extends approximately 160 to 170°, wherein the arm of the toothed spur mechanism includes a base having a ring shape which enables said arm to be fitted rotatably on a pin projecting from a fixed boss fitted to or cast or molded with the blade holder, said elastic return means including a first end which is fixed to a tab on the blade holder and a second end which is fixedly mounted to said arm permitting an elastic interconnection between said arm of said toothed spur mechanism and said cutting device.

* * * * *

UNITED STATES PATENT AND TRADEMARK OFFICE

CERTIFICATE OF CORRECTION

PATENT NO. : 6,457,394 B1
DATED : October 1, 2002
INVENTOR(S) : Maurice Granger

It is certified that error appears in the above-identified patent and that said Letters Patent is hereby corrected as shown below:

Column 3,
Line 13, after the word "plates" please insert -- 5 --, and
Line 21, after the word "the" please delete the word "said".

Signed and Sealed this

Twenty-fifth Day of February, 2003

JAMES E. ROGAN
*Director of the United States Patent and Trademark Office*